United States Patent [19]

Sweeny

[11] Patent Number: 4,641,577

[45] Date of Patent: Feb. 10, 1987

[54] APPARATUS FOR ADJUSTING THE PLATE SEGMENT OF AN OFF-SET LITHOGRAPHIC PRINTER

[76] Inventor: Peter K. Sweeny, 2411 Woolson Rd., Chattanooga, Tenn. 37406

[21] Appl. No.: 722,595

[22] Filed: Apr. 12, 1985

[51] Int. Cl.[4] ..... B41F 1/28

[52] U.S. Cl. ..... 101/415.1; 101/DIG. 12; 269/154; 411/412

[58] Field of Search ..... 101/415.1, 216, 378, 101/217, DIG. 12, 246, 128.1, 418, 407 R; 269/154, 155; 411/409, 411, 412, 413

[56] References Cited

U.S. PATENT DOCUMENTS

| | | | |
|---|---|---|---|
| 2,445,396 | 7/1948 | Gursky | 411/413 X |
| 3,093,025 | 6/1963 | Wasserman | 411/413 |
| 3,218,970 | 11/1965 | Heimlicher et al. | 101/415.1 X |
| 3,258,797 | 7/1966 | Budd | 411/413 X |
| 3,534,694 | 10/1970 | Tafel et al. | 101/415.1 X |
| 3,903,796 | 9/1975 | Jeschke et al. | 101/415.1 |
| 4,596,188 | 6/1986 | Bonomi | 101/378 X |

FOREIGN PATENT DOCUMENTS

| | | | |
|---|---|---|---|
| 213464 | 3/1958 | Australia | 411/412 |
| 1238933 | 4/1967 | Fed. Rep. of Germany | 101/DIG. 12 |
| 2114717 | 9/1972 | Fed. Rep. of Germany | 101/415.1 |
| 2030212 | 7/1973 | Fed. Rep. of Germany | 101/415.1 |
| 414073 | 6/1946 | Italy | 101/DIG. 12 |
| 615791 | 1/1949 | United Kingdom | 101/415.1 |

*Primary Examiner*—Edgar S. Burr
*Assistant Examiner*—Moshe I. Cohen
*Attorney, Agent, or Firm*—Alan Ruderman

[57] ABSTRACT

Apparatus for adjusting the plate segment of an off-set lithographic printing machine drum relative to the drum has first and second blocks, each of which has a threaded bore for receiving the threads of a differential screw. One of the blocks is fastened to the frame of the drum while the other block is moveable on the screw relative to the first block. The threads of the bore in the moveable block have a smaller pitch than the threads in the bore of the fixed block so that the moveable block may be moved in controlled amounts toward and away from the fixed block. The blocks are disposed within a circumferential slot formed on a peripheral edge of the plate segment and as the screw is turned the moveable block acts against an edge of the slot to rotate the plate segment relatively to the drum. A clamp is provided for securing the blocks to the plate segment in adjusted positions.

18 Claims, 6 Drawing Figures

APPARATUS FOR ADJUSTING THE PLATE SEGMENT OF AN OFF-SET LITHOGRAPHIC PRINTER

BACKGROUND OF THE INVENTION

This invention relates to off-set lithography and more particularly to apparatus for adjusting the position of the printed image produced by an off-set lithographic printer, the apparatus acting to change the relative disposition of the image carrying plate segment in a simple and precise manner.

In the art of lithographic printing an image carrying plate, generally a thin metallic plate, has image areas including an affinity for ink while repelling moisture, and non-image areas which retain moisture and do not accept ink. In an off-set lithographic printer, this image plate is mounted on a segment of a rotational cylindrical drum, while another segment of the drum carries a pressure member, both of which act in seriatim in conjunction with an impression receiving and transferring drum rotatably driven in timed relationship with the image carrying drum. The segment of the cylindrical drum which carries the image plate is known in the art as the plate segment while the segment which carries the pressure member is known as the impression segment, both of which are mounted on a rotatably driven skeletal cylindrical frame. The impression receiving and transferring drum is known in the art as the blanket cylinder since its surface is covered by a mat or blanket generally formed from rubber or the like. For each revolution of the image plate carrying cylinder, the blanket cylinder rotates twice. During the first rotation of the blanket cylinder, the blanket contacts the plate segment and receives the ink from the image plate so that the image is transferred onto the blanket. During the second rotation of the blanket cylinder, a sheet of paper is fed to the nip between the blanket and the impression segment of the image plate carrying cylinder. The pressure exerted by the impression segment forces the paper against the blanket and the image thereon is transferred or printed onto the paper. During the rotation of the image plate carrying cylinder after the image plate has transferred its image onto the blanket cylinder it is moistened so that water is transferred to the non-image areas of the plate and thereafter contacted by the ink applying rollers, the ink being transferred only to the areas not retaining water.

It is thus clear that the disposition of the plate segment, and thus the image plate, is determinative of the location of the image on the blanket cylinder and thus the position of the image printed on the paper. This position of the image on a sheet of paper can be critical in many printing operations. This is especially critical where multi-color off-set printing is performed. For example, in multi-color off-set printing an image is printed during a first run with one color and thereafter the same image is subsequently printed again with other individual colors in separate runs, different areas of the image being made receptive to ink for the different colors. The final product will thereby have the different colors disposed in the proper locations if the image plate has been located identically on the image plate carrying cylinder for each color. Since the image plate is clamped to the plate segment by a pair of spaced clamping members, identical positioning of the image plate relative to the plate segment is difficult, if not impossible to accomplish for each color change. Consequently, it is more accurate to mount the image plate on the plate segment as accurately as possible and thereafter correct for misalignment by changing the disposition of the plate segment relative to the skeletal frame of the cylinder.

Various approaches have been made in the prior art to provide accurate adjustment of the plate segment relative to the frame of the cylinder. For example, one method requires the locking of the plate segment against movement relative to the frame of the machine by exerting a pin into a hole in the edge of the plate segment, thereafter loosening the screws which secure the plate segment to the cylinder skeletal frame, and thereafter holding the pin in the hole and turning the machine by hand until the cylinder has been moved the desired amount relative to the plate segment. The securing screws are then tightened and the pin removed. If one inadvertently forgets to remove the pin from the hole after adjustment, great damage may occur to the machine elements when the machine is started. Moreover, even though a tapered pin is utilized, as the pin receiving hole wears, proper locking of the plate segment and adjustment thereof becomes more difficult as the pin tends to slip. If the plate segment is not locked properly, precise adjustment is not attained.

SUMMARY OF THE INVENTION

Consequently, it is a primary object of the present invention to provide apparatus for adjusting the plate segment of an off-set lithographic printing machine relative to the skeletal frame of the image carrying cylindrical drum in a quick, simple and precise manner.

It is another object of the present invention to provide apparatus for adjusting the plate segment of an off-set lithographic printing machine relative to the skeletal frame of the image carrying cylindrical drum, the apparatus being moveable with the drum and the plate segment so that disengagement of a locking member is not required after adjustment has been made.

Accordingly, the present invention provides apparatus for adjusting the plate segment and therefore the image plate of an off-set lithographic printing machine relative to the plate carrying drum to adjust the position of the image on the paper being printed. The apparatus of the present invention comprises a fixed block member adapted to be secured to the skeletal frame of the drum, a traveling adjustable block fastened to the fixed block by means of a differential screw member which has a first set of threads moveable into and out of a tapped bore in the fixed block and a second and finer set of threads receivable within a tapped bore in the traveling block so that as the screw is turned and the first set of threads are moved into and out of the fixed block, the second set of threads move the traveling block in small controlled amounts toward and away from the fixed block. Means are provided for securing the fixed block on a skeletal portion of the cylindrical drum, the blocks having a configuration so that portions thereof are disposed within a circumferential slot in the adjacent peripheral lip of the plate segment. The traveling block abuts one circumferential edge of the slot and as it moves relative to the fixed block it rotates the plate segment relative to the cylindrical drum. A clamping member is adjustably fastened to the fixed block for acting on a lip of the plate segment adjacent the slot. When adjustment of the plate segment is required the clamping member is loosened, the traveling block adjusted to move the plate segment the desired amount, and the clamping member is resecured to fix the plate segment on the cylindrical drum. Although failure to resecure the clamp may result in changes in the position of the plate segment, it would not result in damage to the machine.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
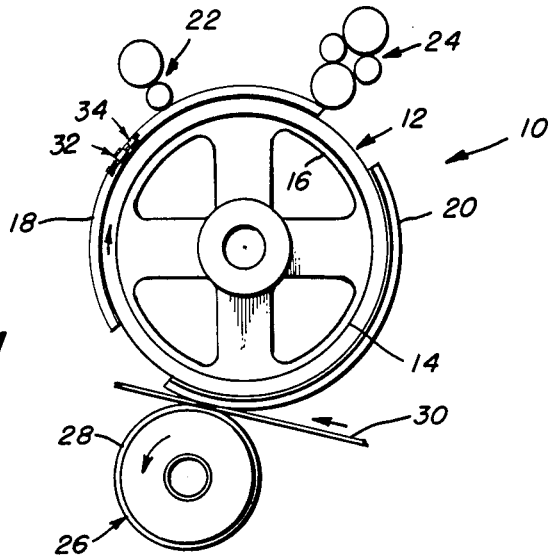
FIG. 1 is a diagrammatic view of a portion of an off-set lithographic printer incorporating apparatus constructed in accordance with the principles of the present invention for adjusting the plate segment relative to the drum.
Figure 2:
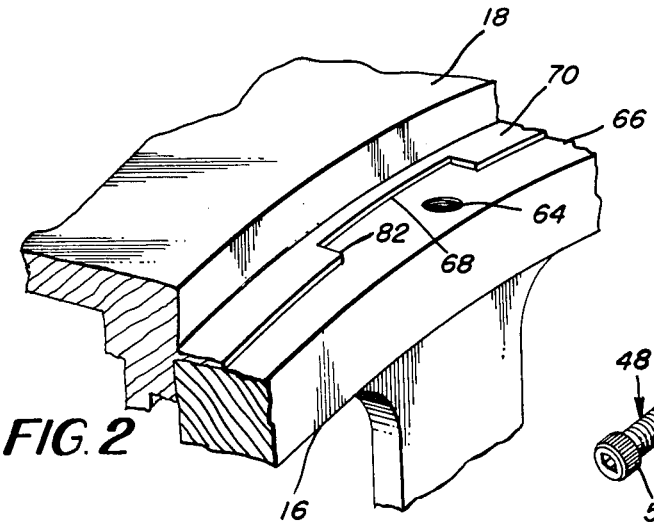
FIG. 2 is a perspective view of a portion of the plate segment and a skeletal mounting member of the cylinderical drum on which it is mounted.

Referring now to FIG. 1, a portion of an off-set lithographic printer 10 is illustrated having a cylindrical drum 12 comprising a rotatable skeletal frame 14 driven in conventional fashion by means including drive members (not illustrated) within the central portion of the drum. The frame 14 includes a spider member 16 known in the art as a "dumbbell" at each end and to which the plate segment 18 and the impression segment 20 are fastened, the image carrying plate (not illustrated) being carried by the plate segment 18. Disposed in operative engagement with the image plate of the plate segment in conventional manner is dampening or moistening means in the form of rollers 22 and inking means in the form of rollers 24. Mounted below the cylindrical drum 12 and rotatable in timed relationship therewith is a blanket cylinder 26 about which a mat or blanket 28 is disposed. As the drum 12 and blanket cylinder 26 rotate the ink carrying portions of the image plate contact the blanket 28 and transfers its image thereto during half a revolution of the drum 12 and a full revolution of the blanket cylinder 26. Then during the next half revolution of the drum 12 the impression segment 20 is disposed oppositely to the blanket cylinder 26 and paper 30 is fed to the nip between the impression segment 20 and the blanket cylinder 26 as the leading edge of the impression segment 20 is about to engage the leading edge of the blanket. The impression segment exerts pressure on the paper and the image on the blanket is transferred to the paper.

Figure 3:
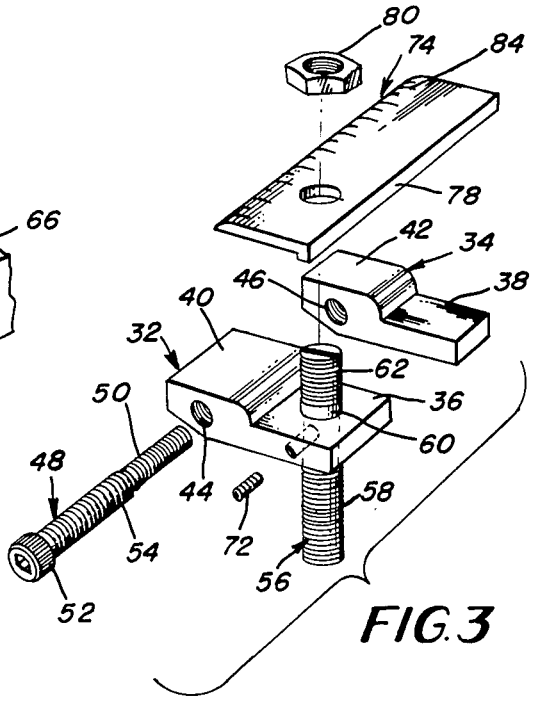
FIG. 3 is a perspective view of the adjusting apparatus of FIG. 1.
Figure 4:
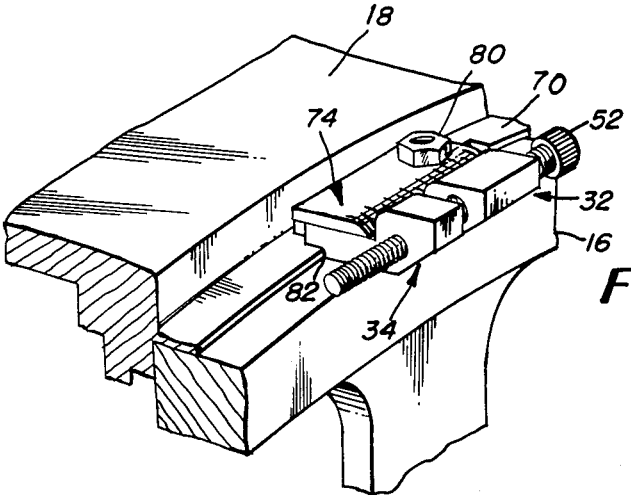
FIG. 4 is a view similar to FIG. 2 with the adjusting apparatus of FIG. 3 attached thereto.
Figure 5:
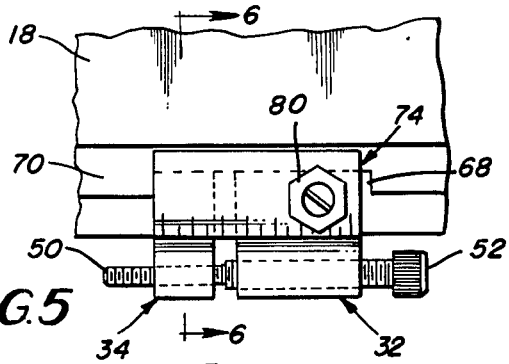
FIG. 5 is a fragmentary top plan view of the structure illustrated in FIG. 4.
Figure 6:
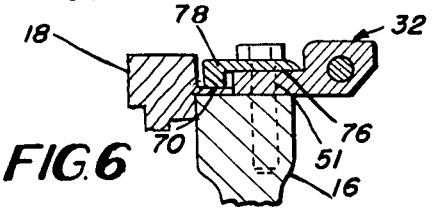
FIG. 6 is a cross sectional view taken substantially along line 6—6 of FIG. 5.

This is the basic method of off-set lithographic printing and is well known to those skilled in the art. It is obvious that correct alignment of the image carrying plate is necessary for aligning the image properly on the paper. This is generally accomplished by adjusting the plate segment 18 relative to the frame of the cylindrical drum 12, and it is to this aspect of the printer that the present invention is directed. As best illustrated in FIG. 3, the plate segment adjusting apparatus includes a first block member 32 hereinafter referred to as the fixed block, and a second block member 34, hereinafter referred to as the transport block. Although it is preferred that the fixed block 32 be longer than the transport block 34, the cross sectional configurations of both blocks are substantially the same. Thus, each block 32, 34 has a substantially flat outwardly extending portion 36, 38 respectively and a raised portion 40, 42 stepped upwardly from one end of the respective outstanding portions 36, 38. Extending longitudinally through both raised portions 40, 42 is a respective bore 44, 46, the bore 46 having a slightly smaller diameter than the bore 44. Each bore 44, 46 is threadedly tapped, the threads in the bore 46 having a smaller pitch than the threads in the bore 44. A differential screw 48 having fine pitch threads 50 corresponding to the threads in the bore 46 on approximately half its axial extent remote from the head 52 is adapted to extend through the bore 44 and is threadedly received within the bore 46. The remainder of the screw 48 has larger pitch threads 54 corresponding to the threads within the bore 44. When the screw 48 is positioned within the bores 44, 46, and when the fixed block 32 is stationary, rotation of the head 52 results in the transport block 34 moving with the screw relative to the fixed block. The amount of movement of the block 34 relative to the block 32 is less than the amount that the screw 48 moves relative to the block 32 due to the differential threads. Thus, very minute and precise control of the movement of the block 34 may be made by turning the screw 48.

Disposed through a bore 51 in the flat lower portion 36 of the block 32 is a threaded stud 56 having a threaded lower portion 58, an unthreaded shoulder portion 60 above the lower portion, and a threaded upper portion 62 above the shoulder portion 60. The threaded lower portion 58 is threadedly received within a tapped bore 64 in the peripheral rim 66 of the dumbbell 16 adjacent to an open ended slot 68 in the peripheral lip 70 at the end of the plate segment 18 adjacent to where the plate segment is normally clamped to the dumbbell. Slot 68 in certain off-set printers is normally formed for receipt of a clamp and a scale used for securing the plate segment to the cylinder and for measuring the movement of the plate segment relative to the cylinder respectively, and in these printers such slots need not be additionally formed for adopting the the adjusting apparatus of the present invention thereto. The circumferential length of the slots 68, however, should be somewhat greater than the combined lengths of the blocks 32 and 34 to permit receipt therein while still permitting movement of the block 34 by means of the screw 48. With the stud 56 properly threadedly secured within the bore 64, the shoulder 60 is within the bore 51 and is secured therein by a set screw 72. Thus, the block 32 may be fixedly secured to the rim 66 of the dumbbell 16 in a disposition wherein the screw 48 is substantially parallel to a tangent drawn to the rim 66 belpw the blocks. Disposed on the upper surfaces of the flat portions 36 and 38 of the blocks is a clamp 74 having a planar surface 76 adapted to act on the upper surfaces of the portions 36 and 38, and a downwardly extending lip 78 at the end of the portion of the surface 76 remote from the blocks 32, 34. The lip 78 is adapted to abut and clamp the peripheral lip 70 of the plate segment 18 inwardly beyond the slot 68 while the surface 76 of the clamp acts against and clamps the blocks 32 and 34. A nut 80 threaded onto the threads 62 at the upper portion of the stud 56 acts to securely force the clamp 74 downwardly against the blocks 32, 34 and the lip 70. This acts to clamp the plate segment 18 to the fixed block 32 and thus to the dumbbell 16.

When adjustment of the image position is desired, the nut 80 is backed off to loosen the clamp 74 from the blocks 32, 34 and the lip 70. Rotation of the screw 48 is then made to move the block 34 in the appropriate direction relative to the block 32 which remains fixed to the dumbbell. As the block 34 is moved it pushes the edge 82 of the lip 70 at the edge of the slot 68 to move the plate segment in the direction of movement of the block 34 or it backs away from the edge 82 and permits the plate segment 18 to be moved until the edge 82 again abuts the block 34, this latter movement of the plate segment may be made by hand, but generally it will be due to the gravitational effects resulting from the disposition of the adjusting position on the drum. After adjustment, the nut is secured to reclamp the plate segment to the dumbbell. The clamp 74 preferably includes indicia 84 for a scale to measure the amount of movement of the plate segment relative to the dumbbell. Although clamping members may be disposed on each end of the plate segment for securing it to the respective dumbbells, only one end need have the adjusting apparatus. However, before and after adjustment all the clamps should be loosened and secured respectively.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. In an off-set lithographic printer having a rotational cylindrical drum including skeletal frame members and an image carrying plate segment mounted on said frame members, adjusting apparatus for changing the position of the plate segment relative to the frame members to align the image produced by said printer, said apparatus comprising a first block including a threaded bore extending therethrough, a second block including a threaded bore extending therethrough, a screw threadedly extending through the bores of both said first and said second blocks, means for securing said first block to one of said frame members adjacent said plate segment, a circumferentially extending slot formed in the plate segment adjacent to said first block, said slot opening toward said blocks and having edges defining the circumferential extents of the slot, each of said first and second blocks having protuberances extending remotely from the screw receiving threaded bores disposed in said slot, whereby rotation of said screw effects movement of said second block relative to said first block for abutting one of said edges of said slot by a surface of the protuberance of said second block to move the plate segment with the second block relative to said frame members, and a releasable clamp for securing the plate segment to at least the first block and thus the frame member in selected positions.

2. In an off-set lithographic printer as recited in claim 1, wherein said screw is a differential screw having first threads receivable within the threaded bore of said first block and second threads receivable within the threaded bore of said second block, the pitch of said second threads being less than the pitch of said first threads, whereby rotation of said screw moves the second block relative to said first block precise distances as said screw is fed through said blocks.

3. In an off-set lithographic printer as recited in claim 2, wherein said means for securing said first block to said frame comprises means for mounting said clamp on said first block.

4. In a lithographic printer as recited in claim 3, wherein said clamp comprises a plate disposed on the protuberance of at least said first block, said plate having a lip depending downwardly therefrom remote from said block for abuttment with said plate segment, and fastening means for forcing said plate onto the protuberance of said first block and said lip onto said plate segment.

5. In an off-set lithographic printer as recited in claim 4, wherein said clamp is disposed on the protuberance of said first and second blocks.

6. In an off-set lithographic printer as recited in claim 2, wherein said blocks are disposed on said frame member with said screw disposed substantially parallel to a plane tangent to the surface of said frame member.

7. In an off-set lithographic printer as recited in claim 6, wherein said means for securing said first block to said frame comprises means for mounting said clamp on said first block.

8. In an off-set lithographic printer as recited in claim 7, wherein said clamp comprises a plate disposed on the protuberance of at least said first block, said plate having a lip depending downwardly therefrom remote from said block for abuttment with said plate segment, and fastening means for forcing said plate onto the protuberance of said first block and said lip onto said plate segment.

9. In an off-set lithographic printer as recited in claim 8, wherein said clamp is disposed on the protuberance of said first and second blocks.

10. In an off-set lithographic printer as recited in claim 9, wherein said means for securing said first block to said frame comprises a threaded stud secured to said frame, and means for securing said stud to the protuberance of said first block.

11. In an off-set lithographic printer as recited in claim 10, wherein said stud extends through said protuberance and through said plate, and said fastening means comprises means adjustably secured to said stud above said plate for forcing said plate onto said protuberance.

12. A cylindrically shaped plate segment supported on a cylindrical frame member and adjusting apparatus for changing the position of said plate segment relative to said frame member, said apparatus comprising a first block including a threaded bore extending therethrough, a second block including a threaded bore extending therethrough, a screw threadedly extending through the bores of both said first and second blocks, a circumferencially extending slot formed in said plate segment overlaying a portion of said frame member, each of said first and second blocks having protuberances extending remotely from the screw receiving bores, means for securing said first block to said frame member with said protuberances disposed in said slot, the protuberance of said second block being disposed for abutment with a terminal edge of said slot, and clamping means for securing at least said first block to said plate segment.

13. Adjusting apparatus as recited in claim 12, wherein said blocks are disposed on said frame member with said screw disposed substantially parallel to a plane tangent to the surface of said frame member.

14. Adjusting apparatus as recited in claim 13, wherein said clamping means is disposed on the protuberance of said first block, and means for compressing said clamping means onto said protuberance and said plate segment.

15. Adjusting apparatus as recited in claim 14, wherein said clamping means comprises a plate disposed on the protuberance of at least said first block, said plate having a lip depending downwardly therefrom remote from said block for abuttment with said plate segment, and fastening means for forcing said plate onto the protuberance of said first block and said lip onto said plate segment.

16. Adjusting means as recited in claim 15, wherein said clamp is disposed on the protuberance of said first and second blocks.

17. Adjusting means as recited in claim 16, wherein said means for securing said first block to said frame comprises a threaded stud secured to said frame, and means for securing said stud to the protuberance of said first block.

18. Adjusting means as recited in claim 17, wherein said stud extends through said protuberance and through said plate, and said fastening means comprises means adjustably secured to said stud above said plate for forcing said plate onto said protuberance.

* * * * *